United States Patent [19]

Cardena'

[11] Patent Number: 5,020,339

[45] Date of Patent: Jun. 4, 1991

[54] TRANSFORMABLE EARRING

[76] Inventor: Carlo Cardena', 8 Via Angiolo Cabrini, I-00139 Roma RM, Italy

[21] Appl. No.: 382,795

[22] PCT Filed: Nov. 3, 1988

[86] PCT No.: PCT/IT88/00079

§ 371 Date: Jul. 5, 1989

§ 102(e) Date: Jul. 5, 1989

[87] PCT Pub. No.: WO89/04127

PCT Pub. Date: May 18, 1989

[30] Foreign Application Priority Data

Nov. 5, 1987 [IT] Italy ..... 36095/87[U]

[51] Int. Cl.[5] ..... A44C 7/00

[52] U.S. Cl. ..... 63/13; 63/31

[58] Field of Search ..... 63/12, 13, 14.1–14.8, 63/31

[56] References Cited

U.S. PATENT DOCUMENTS

| | | | |
|---|---|---|---|
| 249,201 | 11/1881 | Oliver | 63/12 |
| 2,682,759 | 7/1954 | Chalikian et al. . | |
| 3,613,393 | 10/1971 | Lamoureux . | |
| 4,059,971 | 11/1977 | Shoji | 63/31 X |

*Primary Examiner*—James R. Brittain

*Attorney, Agent, or Firm*—Browdy and Neimark

[57] ABSTRACT

An earring which can be transformed from a button-like type to a pendant-like type comprises two hinged elements which can be either closed or opened.

2 Claims, 2 Drawing Sheets

TRANSFORMABLE EARRING

The present invention refers to a transformable earring.

In the field of jewelry and costume jewelry, conventional earrings are differentiated into two basic classes, a first class so-called "button-like", in which the jewel has a compact shape and is directly applied onto the ear lobe by means of a clip, a stud or the like, and a second class so-called "pendant-like", in which the earring comprises a part hanging on a support, to be applied to the ear by means of any one of the above mentioned fasteners.

Conventionally, the earrings are all produced in a separate manner according to the first or the second above mentioned class.

An object of the present invention is to provide an earring transformable from a "button-like" type to a pendant-like type, and vice versa, thus enabling the different requirements of the public to be met with one single jewel.

The earring of the present invention comprises:

a fixed element; a movable element having an aperture therethrough, the fixed and movable elements being hingedly connected at a lowermost portion of the fixed element, so that the movable element can rotate to assume a closed position adjacent to the fixed element forming a button-like type of earring, and an open position in which the movable element freely hangs below the fixed element forming a pendant-like type of earring; and a fastener mounted on the fixed element for releasably locking the earring to the ear lobe of a wearer, the fastener extending through the aperture in the closed position of the movable element and, when released, being free from interference with the movable element in the rotation thereof to its open position.

The present invention will be further illustrated by the following description of an embodiment, with reference to the accompanying drawings, in which.

Figure 1:
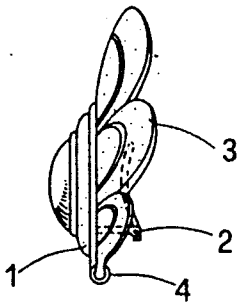
FIG. 1 is a side elevation view of an earring accord to the invention in a closed "button-like" condition.
Figure 5:
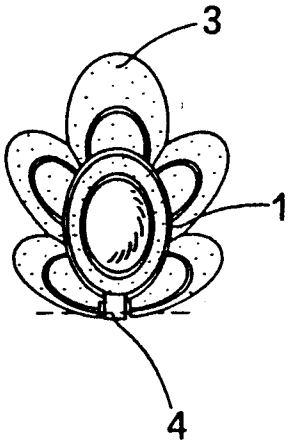
FIG. 5 is a front elevation view of the earring in FIG. 1 in the closed button-like condition.

Referring to the drawings, an earring, as an embodiment of the present invention, is a combination of a first or fixed element 1 to be applied to the ear lobe, for example by means of a spring fastener or clip 2, mounted on its rear face, and a second or movable element 3 pivotally connected to a lowermost part of the first fixed element by means of a hinge 4. With the fixed and movable elements 2 and 3 in the closed condition, the second element cooperates with the first one to form the ornamental pattern of the earring in the button-like modification, as shown in FIGS. 1 and 5.

Figure 2:
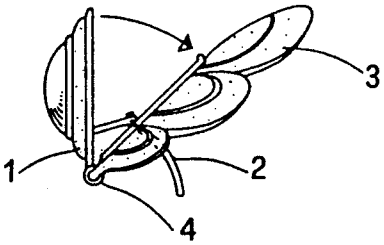
FIG. 2 is a side elevation view of the earring in FIG. 1 during the transformation from the closed button-like condition to the open pendant-like condition.
Figure 3:
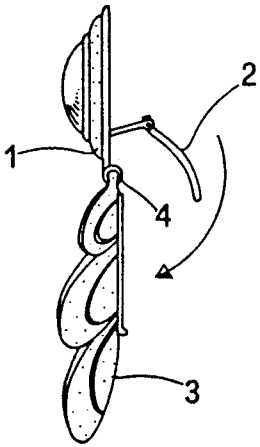
FIG. 3 is a side elevation view of the earring in FIG. 1 transformed into the open pendant-like condition.
Figure 6:
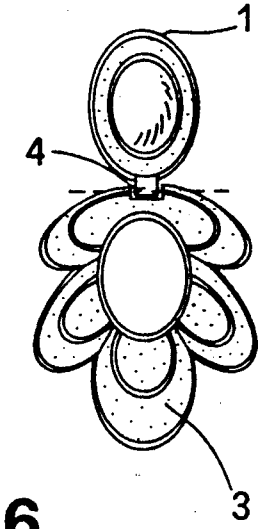
FIG. 6 is a front elevation view of the earring in FIG. 1 in the open pendant-like condition.

When the transformation of the earring from the button-like type to the pendant-like type is wished, the clip 2 is moved from the operating position, in which it was blocking the movable element 3 on the fixed element 2, to the turned back position as shown in FIGS. 2 and 3. The movable element 3 is then rotated backwards around the hinge 4 until it rests in the hanging condition shown in the FIGS. 3 and 6.

By an inverse operation it is possible with ease and when desired, to bring the earring of the invention back from the open pendant-like position to the closed button-like condition.

Figure 4:
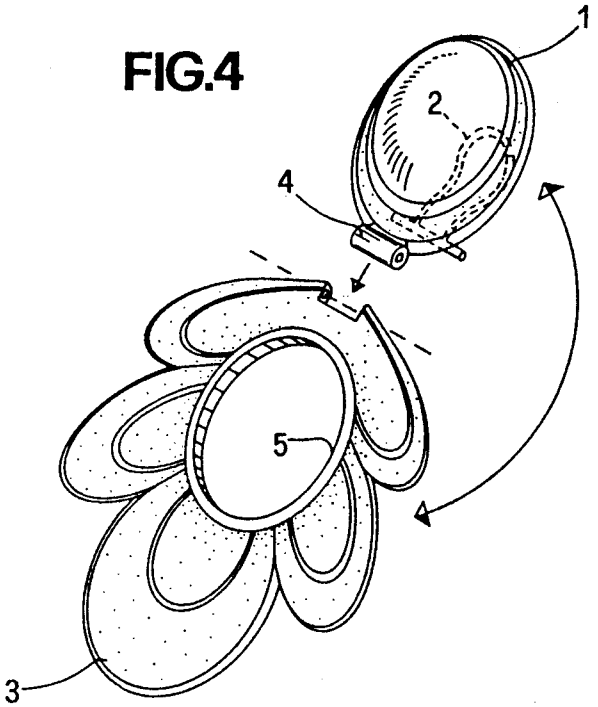
FIG. 4 is an exploded perspective view, in an enlarged scale, of the earring in FIG. 1, illustrating the system of transformation from the closed button-like condition to the open pendant-like condition, and vice versa.

It will be appreciated that an opening is provided in the body of the movable element 3, such as indicated in 5 on FIG. 4, for the passage of the fastening clip, mounted on the fixed element 2, during the downwards or upwards rotation of the movable element 3 for the transformation of the earring from a button-like to a pendant-like type or vice versa.

It is also to be appreciated that for fixing the earring to the ear lobe any known fastener can be provided on the fixed element 1, other than the clip of the present embodiment, such as a stud to be inserted in a bore made in the ear lobe.

The present invention is not restricted to the embodiment as described, and it comprises equivalent modifications.

I claim:

1. A transformable earring formed of a fixed element (1), having a front side and a rear side, and a movable element (3) having an aperture (5) therethrough, said fixed and movable elements being hingedly connected at a lowermost portion of the fixed element, so that the movable element (3) can rotate about said hinged connection between a closed position to assume the form of a button-like type of earring and an open position in which the movable element (3) is pendent on the fixed element (1) to form a pendant-like type of earring; and a fastener (2) mounted on the rear side of said fixed element (1) for releasably locking the earring to the ear lobe of a wearer, said fixed element having said fastener thereon disposed in operative relationship to allow the rotation of said movable element to said open position through a space on the rear side of said fixed element whereby said fastener passes through said aperture with no interference between said fastener and said movable element, and wherein there is interference between said movable element and fixed element in said closed position to prevent the movable element from passing to the front side of the fixed element.

2. Earring according to claim 1, in which said fastener is a clip.

* * * * *